US009913500B1

(12) United States Patent
Matthews

(10) Patent No.: US 9,913,500 B1
(45) Date of Patent: Mar. 13, 2018

(54) ELASTICIZED CUSHIONED THERMAL GLOVE

(71) Applicant: Yolanda J. Matthews, Jamaica, NY (US)

(72) Inventor: Yolanda J. Matthews, Jamaica, NY (US)

( * ) Notice: Subject to any disclaimer, the term of this patent is extended or adjusted under 35 U.S.C. 154(b) by 230 days.

(21) Appl. No.: 14/661,824

(22) Filed: Mar. 18, 2015

(51) Int. Cl.
*A41D 13/005* (2006.01)
*A41D 19/00* (2006.01)
*A41D 19/015* (2006.01)

(52) U.S. Cl.
CPC ..... *A41D 13/0051* (2013.01); *A41D 13/0053* (2013.01); *A41D 19/0013* (2013.01); *A41D 19/01523* (2013.01)

(58) Field of Classification Search
CPC ..... A41D 13/0051; A41D 13/0053; A41D 19/0013; A41D 19/01523; A41D 13/082; A41D 19/0048
USPC ..... 2/20
See application file for complete search history.

(56) References Cited

U.S. PATENT DOCUMENTS 2,792,827 A * 5/1957 Gravin ..... A41D 19/01535 126/204
3,292,628 A * 12/1966 Maxwell ..... A61F 7/007 2/158
3,569,666 A * 3/1971 Murphy ..... A41D 19/01535 126/204
3,621,191 A * 11/1971 Cornwell ..... A41D 19/01535 2/158
3,632,966 A * 1/1972 Arron ..... H05B 3/342 2/158
3,712,288 A * 1/1973 Weiss ..... A41D 19/01535 126/206
3,867,611 A * 2/1975 Riley ..... A43B 7/025 219/211
3,869,594 A * 3/1975 Shively ..... A41D 19/01535 165/46
4,021,640 A * 5/1977 Gross ..... A41D 19/01535 2/159
4,087,675 A * 5/1978 Sansonetti ..... H05B 3/342 2/158
4,281,418 A * 8/1981 Cieslak ..... A43B 7/02 126/206
4,535,482 A * 8/1985 Spector ..... A41D 19/01535 2/160
4,543,671 A * 10/1985 Monk ..... A41D 19/01535 2/158
4,950,868 A * 8/1990 Moss ..... A41D 13/0051 219/211
5,035,003 A 7/1991 Rinehart
5,050,596 A 9/1991 Walasek et al.
5,070,223 A 12/1991 Colasante
(Continued)

*Primary Examiner* — Alissa L Hoey
(74) *Attorney, Agent, or Firm* — Stevenson IP, LLC

(57) ABSTRACT

The elasticized cushioned thermal glove provides heating, cooling, and compression modalities. The constant fluidity of the gel disposed in the gel bladders substantially throughout the glove palm side is in constant fluidity when heated and cooled. The gel is pre-heated via a power module, heatable when in use, and also pre-cooled prior to use. The glove is also provided as a compression glove to alleviate pain, swelling, and to provide for support for those in need. As the glove provides these heating and cooling advantages, fingers can be left in an open state to enhance dexterity as opposed to full-fingered gloves.

4 Claims, 3 Drawing Sheets

(56) References Cited

U.S. PATENT DOCUMENTS 5,187,814 A * 2/1993 Gold ..... A41B 11/00 2/160
5,214,799 A * 6/1993 Fabry ..... A41D 19/01523 2/161.6
5,257,418 A * 11/1993 Jaskiewicz ..... A41D 19/01523 2/161.1
5,581,809 A * 12/1996 Mah ..... A41D 19/01523 2/161.1
5,603,118 A * 2/1997 Solomon ..... A41D 19/01523 2/160
5,790,980 A * 8/1998 Yewer, Jr. ..... A41D 19/01523 2/161.1
6,049,062 A * 4/2000 Jones ..... A41D 13/0051 219/211
6,098,200 A * 8/2000 Minkow ..... A41D 19/01523 2/161.1
6,141,801 A * 11/2000 Helenick ..... A41D 19/01535 2/159
6,239,410 B1 * 5/2001 Tackore ..... A41D 19/01535 219/211
6,618,860 B1 * 9/2003 Sullivan ..... A63B 71/141 2/159
7,025,709 B2 * 4/2006 Riggall ..... A63B 21/00189 2/160
7,043,768 B2 * 5/2006 Gogarty ..... A41D 19/01535 2/161.1
7,458,106 B2 * 12/2008 Yue ..... A41D 19/01535 2/159
8,196,219 B2 * 6/2012 Roeckl ..... A41D 19/015 2/159
9,089,176 B1 * 7/2015 Crowder ..... A41D 13/0053
9,295,580 B1 * 3/2016 Deola ..... A61F 7/03
9,491,976 B2 * 11/2016 Pierias ..... A41D 13/0051
2003/0109910 A1 * 6/2003 Lachenbruch ..... A61F 5/0104 607/108
2003/0188373 A1 * 10/2003 Garneau ..... A41D 19/01523 2/161.1
2004/0164066 A1 * 8/2004 Ford ..... A41D 13/0051 219/211
2004/0244090 A1 * 12/2004 Langer ..... A41D 19/002 2/160
2006/0168706 A1 * 8/2006 Auger ..... A41D 19/01523 2/161.6
2006/0195968 A1 * 9/2006 Powell ..... A41D 19/01523 2/161.1
2007/0113317 A1 * 5/2007 Garneau ..... A41D 19/01523 2/161.1
2007/0150999 A1 * 7/2007 Brown ..... A41D 19/0048 2/159
2009/0289046 A1 * 11/2009 Richmond ..... A41D 13/0051 219/211
2009/0307820 A1 * 12/2009 Yang ..... A41D 19/01523 2/19
2011/0055995 A1 * 3/2011 Dassler ..... A41D 19/01523 2/161.1
2012/0017349 A1 * 1/2012 McCrane ..... A63B 21/4019 2/161.1
2012/0074128 A1 * 3/2012 Blackford ..... A41D 13/0051 219/487
2015/0083704 A1 * 3/2015 Guidry ..... A41D 19/0024 219/211
2015/0382402 A1 * 12/2015 Chen ..... A41D 13/0051 219/211
2016/0113064 A1 * 4/2016 Gluckman ..... A41D 19/0024 219/211

* cited by examiner

ELASTICIZED CUSHIONED THERMAL GLOVE

BACKGROUND OF THE INVENTION

Various types and varieties of gloves are known in the prior art. Cushioned gloves are known yet often fail to fully cushion completely, most relying upon cushioning in the knuckle and palm of the hand only. Some thermal gloves provide a partial fill with a material that can be heated and cooled by an existing external source. What is needed is a thermal, cushioned, compression glove that provides even more than the above listed singular advantages. What is further needed is a glove that can be either pre-heated or continuously heated when in use. The current elastics cushioned thermal glove provides these combined advantages.

FIELD OF THE INVENTION

The present elasticized cushioned thermal glove relates to thermal gloves.

SUMMARY OF THE INVENTION

The general purpose of the elasticized cushioned thermal glove, described subsequently in greater detail, is to provide an elasticized cushioned thermal glove that has many novel features that result in an elasticized cushioned thermal glove which is not anticipated, rendered obvious, suggested, or even implied by prior art, either alone or in combination thereof.

To accomplish this, the elasticized cushioned thermal glove comprises a compression glove with a palm side spaced apart from a back side. A quartet of adjacently disposed abbreviated fingers and a separate abbreviated thumb are provided. An opening is disposed at a terminus of each finger and of the thumb. A glove wrist is disposed at a glove terminus opposite the fingers. A heel is disposed adjacent the glove wrist of the palm side. A palm is disposed within an approximate center of the palm side. A knuckle is disposed adjacent the fingers of the palm side. A plurality of frictional micro beads is disposed on the palm side to aid in grip of various objects. A hook and loop strap alternately secures and releases a user's wrist within the glove wrist.

An electrical access port is disposed within the glove wrist. The electrical access electrical access port has a tether affixed to a cap. The cap alternately uncovers and covers the electrical access port, therein preventing invasion and obstruction by foreign material when the electrical access port is not in use. A plurality of operationally communicating gel bladders is disposed interiorly within the palm side. The gel bladders are in operational communication with the electrical access port.

The gel bladders comprise a wrist bladder disposed within the hook and loop strap and a heel bladder disposed within an area of the palm side filled by the heel of a hand. The gel bladders further comprise a palm bladder disposed in an approximate glove center and a thumb bladder disposed in the thumb. A plurality of channels is provided for gel bladder fluid connection. The thumb bladder is in fluid connection with the palm bladder via a channel. A knuckle bladder is disposed most proximal the palm bladder in the knuckle. The knuckle bladder is in fluid connection with the palm bladder via one channel. A finger bladder is disposed within each finger. Each finger bladder is in fluid connection with the knuckle bladder via separate channels.

A thermal gel is disposed within the gel bladders and the channels. The thermal gel is alternately heated and cooled and retains fluidity. A continuous flexible heating element is disposed throughout the gel bladders. The heating element is in operational communication with the electrical access port. A power module is disposed separately from the glove. The power module has a 12 volt transformer, a cigar lighter plug, an electrical outlet plug, and a glove insert insertable into the electrical access port. The thermal gel is alternately heated by electricity via the power module and pre-cooled by an existing refrigeration source.

Gel bladders and channels are relegated to the palm side in order to best transfer heating and cooling to the most highly blood circulated portions of a hand, as opposed to the back of a hand which is highly restricted, in comparison, with blood flow. The glove also provides cushioning against objects. With heating and cooling effectively delivered to a hand, the fingertips can be left uncovered to provide dexterity not inherent in full fingered gloves, especially since a bladder is provided in the finger area beyond the first finger knuckles, as with the thumb. The glove is provided as a typical, sized glove, without elastic fit. The glove is provided as an elasticized glove. The glove is further provided as an elasticized compression glove in order to alleviate swelling and discomfort experienced by some prospective users. Compression is accomplished by a tight elasticized fit with a reinforced material. The hook and loop strap is provided both without and with the wrist bladder. Micro beads can be provided on the palm side to enhance grip.

Thus has been broadly outlined the more important features of the present elasticized cushioned thermal glove so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
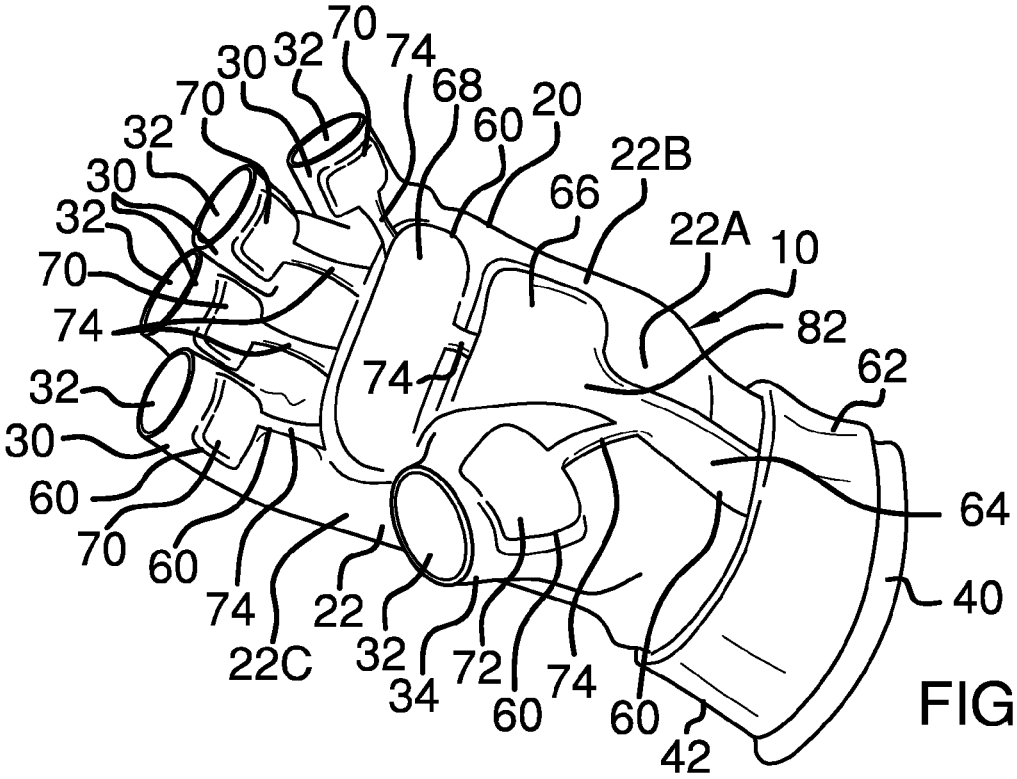
FIG. 1 is a palm side perspective view.
Figure 2:
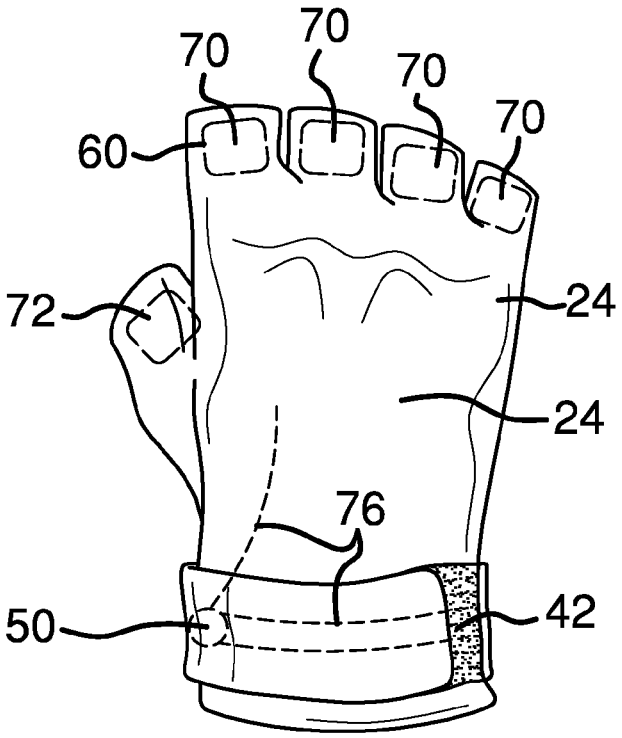
FIG. 2 is a back side view.
Figure 3:
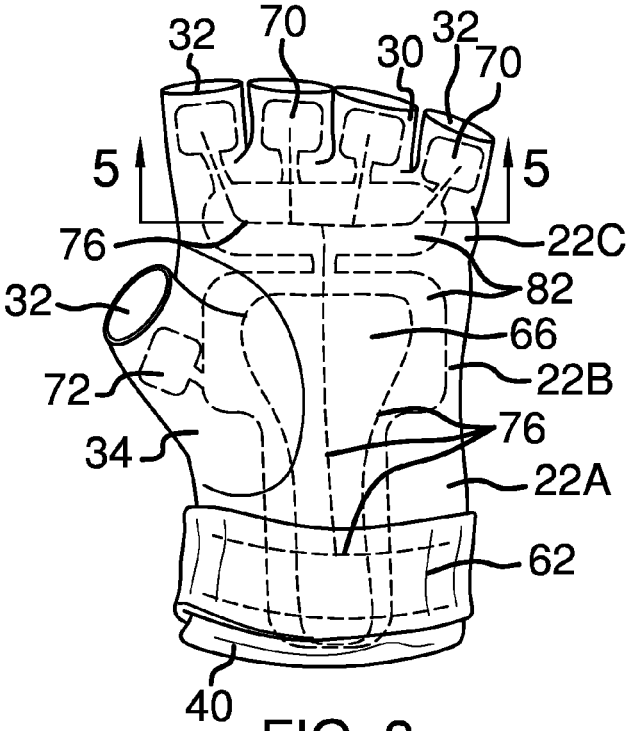
FIG. 3 is a palm side view.
Figure 4:
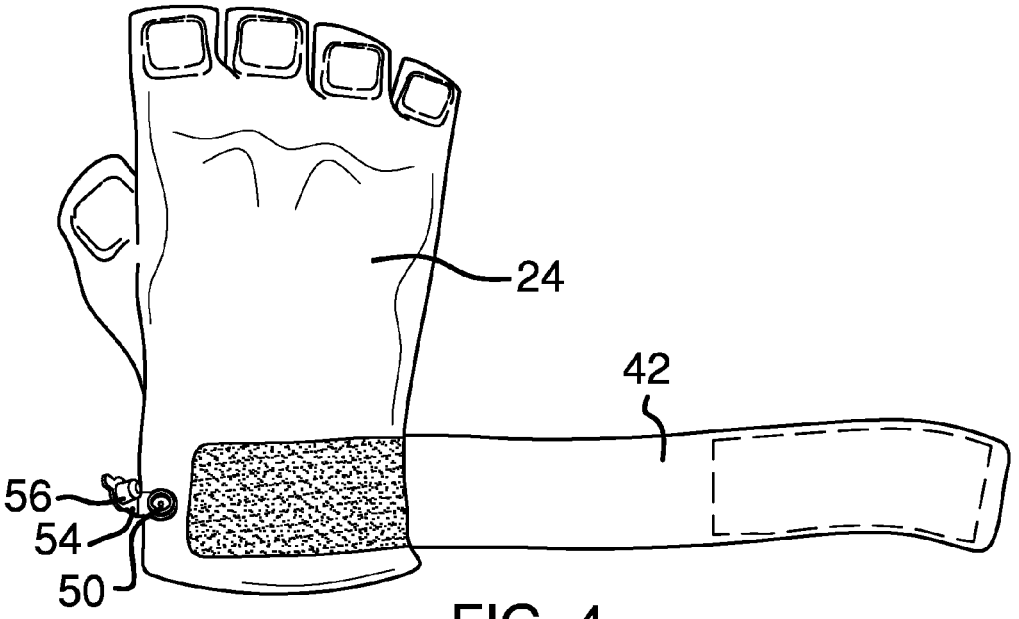
FIG. 4 is a back side view.
Figure 5:
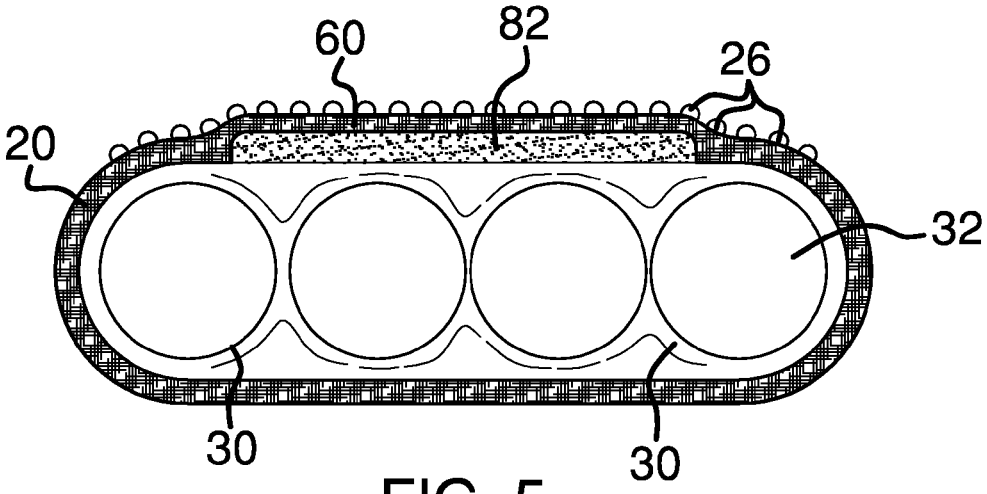
FIG. 5 is a cross sectional view of FIG. 3, taken along the lines 5-5.
Figure 6:
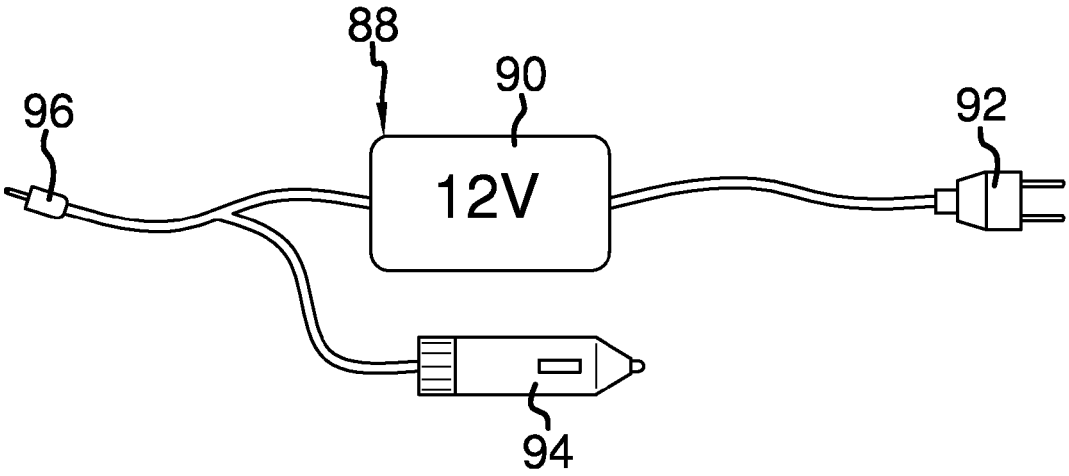
FIG. 6 is a top plan view of a power module.

With reference now to the drawings, and in particular FIGS. 1 through 6 thereof, an example of the elasticized cushioned thermal glove employing the principles and concepts of the present elasticized cushioned thermal glove and generally designated by the reference number 10 will be described.

Referring to FIGS. 1 through 6, an elasticized cushioned thermal glove 10 is provided. An elasticized compression glove 20 has a palm side 22 spaced apart from a back side 24. A quartet of adjacently disposed abbreviated fingers 30 and a separate abbreviated thumb 34 are provided. An opening 32 is disposed at a terminus of each finger 30 and of the thumb 34. A glove wrist 40 is disposed at a glove terminus opposite the fingers 30. A heel 22A is disposed adjacent the glove wrist 40 of the palm side 22. A palm 22B is disposed within an approximate center of the palm side 22. A knuckle 22C is disposed adjacent the fingers 30 of the palm side 22. A plurality of frictional micro beads 26 is disposed on the palm side 22 to aid in grip of various objects. A hook and loop strap 42 alternately secures and releases a user's wrist within the glove wrist 40.

An electrical access port 50 is disposed within the glove wrist 40. The electrical access port 50 has a tether 54 affixed to a cap 56, wherein the cap 56 alternately uncovers and covers the electrical access port 50, therein preventing invasion and obstruction by foreign material when the electrical access port 50 is not in use. A plurality of fluidly interconnected gel bladders 60 is disposed interiorly within the palm side 22.

The gel bladders 60 are in operational communication with the electrical access port 50. The gel bladders 60 comprise a wrist bladder 62 disposed within the hook and loop strap 42 and a heel bladder 64 disposed within an area of the palm side 22 filled by the heel of a hand. The gel bladders 60 further comprise a palm bladder 66 disposed in an approximate glove center and a thumb bladder 72 disposed in the thumb. The thumb bladder 72 is in fluid connection with the palm bladder 66 via a channel 74. A knuckle bladder 68, also a gel bladder 60, is disposed most proximal the palm bladder 66 in the knuckle 22C. A plurality of channels 74, also gel bladders 60, is provided for bladder fluid interconnection. The knuckle bladder 68 is fluidly connected with the palm bladder 66 via one channel 74. A finger bladder 70, another gel bladder 60, is disposed within each finger 30. Each finger bladder 70 is fluidly connected with the knuckle bladder 68 via separate channels 74.

A thermal gel 82 is disposed within the gel bladders 60 and the channels 74. The thermal gel 82 retains fluidity when alternately heated and cooled. A continuous flexible heating element 76 is disposed throughout the bladders. The heating element 76 is in operational communication with the electrical access 50. A power module 88 is disposed separately from the glove 20. The power module 88 has a 12 volt transformer 90, a cigar lighter plug 94, an electrical outlet plug 92, and a glove insert 96 insertable into the electrical access port 50. The thermal gel 82 is alternately heated by electricity via the power module 88 and pre-cooled by an existing refrigeration source. The elastic glove 20 provides compression for a hand.

What is claimed is:

1. A cushioned thermal glove comprising:

a glove having a palm side spaced apart from a back side, a quartet of adjacently disposed abbreviated finger portions, an abbreviated thumb portion disposed separately from the finger portions, an opening disposed at a terminus of each finger portion of the quartet of finger portions and of the thumb portion, a glove wrist disposed at a glove terminus opposite the finger portions, a heel portion disposed adjacent the glove wrist in the palm side, a palm portion disposed within a center of the palm side, a knuckle portion disposed adjacent the finger portions of the palm side;

a hook and loop strap configured to alternately secure and release a user's wrist within the glove wrist;

a plurality of fluidly interconnected gel bladders disposed interiorly within the palm side; the gel bladders comprising:

a heel bladder disposed within the heel portion of the palm side;

a palm bladder disposed in the palm portion;

a thumb bladder disposed in the thumb portion, the thumb bladder in fluid connection with the palm bladder via a first channel of a plurality of channels;

a knuckle bladder disposed most proximal the palm bladder in the knuckle portion, the knuckle bladder in fluid connection with the palm bladder via a second channel of the plurality of channels;

a finger bladder disposed within each finger portion of the quartet of finger portions, each finger bladder in fluid connection with the knuckle bladder via a third, fourth, fifth, and sixth channel of the plurality of channels, respectively; and a thermal gel disposed within the gel bladders and the channels wherein the thermal gel retains fluidity when alternately heated and cooled;

wherein the thermal gel is configured to be alternately pre-heated and pre-cooled.

2. A cushioned thermal glove system comprising:

an elasticized glove having a palm side spaced apart from a back side, a quartet of adjacently disposed abbreviated finger portions, an abbreviated thumb portion disposed separately from the finger portions, an opening disposed at a terminus of each finger portion of the quartet of finger portions and of the thumb portion, a glove wrist disposed at a glove terminus opposite the finger portions, a heel portion disposed adjacent the glove wrist in the palm side, a palm portion disposed within a center of the palm side, a knuckle portion disposed adjacent the finger portions of the palm side;

a hook and loop strap configured to alternately secure and release a user's wrist within the glove wrist;

an electrical access port disposed within the glove wrist, the electrical access port having a tether affixed to a cap, wherein the cap alternately uncovers and covers the electrical access port;

a plurality of channels disposed within the palm side;

a plurality of gel bladders fluidly interconnected via the channels disposed interiorly within the palm side, the gel bladders in fluid connection with the electrical access port, the gel bladders comprising:

a heel bladder disposed within the heel portion of the palm side;

a palm bladder disposed in the palm portion;

a thumb bladder disposed in the thumb portion, the thumb bladder in fluid connection with the palm bladder via a first channel of the plurality of channels;

a knuckle bladder disposed most proximal the palm bladder in the knuckle portion, the knuckle bladder in fluid connection with the palm bladder via a second channel of the plurality of channels;

a finger bladder disposed within each finger portion of the quartet of finger portions, each finger bladder in fluid connection with the knuckle bladder via a third, fourth, fifth and sixth channel of the plurality of channels, respectively;

a thermal gel disposed within the gel bladders and the channels wherein the thermal gel retains fluidity when alternately heated and cooled;

a continuous flexible heating element disposed throughout the gel bladders, the heating element in operational communication with the electrical access port; and a power module disposed separately from the glove, the power module having a 12 volt transformer, a cigar lighter plug, an electrical outlet plug, and a glove insert insertable into the electrical access port;

wherein the thermal gel is configured to be alternately heated by electricity via the power module and pre-cooled by an existing refrigeration source.

3. A cushioned thermal glove system comprising:

an elasticized glove having a palm side spaced apart from a back side, a quartet of adjacently disposed abbreviated finger portions, an abbreviated thumb portion disposed separately from the finger portions, an opening disposed at a terminus of each finger portion of the quartet of finger portions and of the thumb portion, a glove wrist disposed at a glove terminus opposite the finger portions, a heel portion disposed adjacent the glove wrist in the palm side, a palm portion disposed within a center of the palm side, a knuckle portion disposed adjacent the finger portions of the palm side;

a hook and loop strap configured to alternately secure and release a user's wrist within the glove wrist;

an electrical access port disposed within the glove wrist, the electrical access port having a tether affixed to a cap, wherein the cap alternately uncovers and covers the electrical access port;

a plurality of channels disposed within the palm side;

a plurality of gel bladders fluidly interconnected via the channels disposed interiorly within the palm side, the gel bladders in fluid connection with the electrical access port, the gel bladders comprising:

a heel bladder disposed within the heel portion of the palm side;

a palm bladder disposed in the palm portion;

a thumb bladder disposed in the thumb portion, the thumb bladder in fluid connection with the palm bladder via a first channel of the plurality of channels;

a knuckle bladder disposed most proximal the palm bladder in the knuckle portion, the knuckle bladder in fluid connection with the palm bladder via a second channel of the plurality of channels;

a finger bladder disposed within each finger portion of the quartet of finger portions, each finger bladder in fluid connection with the knuckle bladder via a third, fourth, fifth, and sixth channel of the plurality of channels, respectively;

a thermal gel disposed within the gel bladders and the channels wherein the thermal gel retains fluidity when alternately heated and cooled;

a continuous flexible heating element disposed throughout the gel bladders, the heating element in operational communication with the electrical access port; and a power module disposed separately from the glove, the power module having a 12 volt transformer, a cigar lighter plug, an electrical outlet plug, and a glove insert insertable into the electrical access port;

wherein the thermal gel is configured to be alternately heated by electricity via the power module and precooled by an existing refrigeration source; and wherein the elastic glove is configured to provide compression for a hand.

4. The glove of claim 3 wherein a plurality of frictional micro beads is disposed on the palm side.

* * * * *